United States Patent [19]

Ogaki et al.

[11] Patent Number: 4,474,410

[45] Date of Patent: Oct. 2, 1984

[54] POWER-DRIVEN, WEDGE-OPERATED ROCK SPLITTER

[75] Inventors: Koji Ogaki, Yokohama; Shigetake Akanuma, Chigasaki; Yoshinori Takada, Isehara; Yoshitaka Ojiro, Isehara; Shigeru Harada, Isehara, all of Japan

[73] Assignee: Kabushiki Kaisha Komatsu Seisakusho, Tokyo, Japan

[21] Appl. No.: 360,364

[22] Filed: Mar. 22, 1982

[30] Foreign Application Priority Data

Mar. 31, 1981 [JP] Japan ..... 56-44455[U]
Mar. 31, 1981 [JP] Japan ..... 56-44456[U]
Mar. 31, 1981 [JP] Japan ..... 56-44457[U]

[51] Int. Cl.[3] ..... E21C 37/04
[52] U.S. Cl. ..... 299/23; 299/22
[58] Field of Search ..... 299/22, 23; 125/23 R

[56] References Cited

U.S. PATENT DOCUMENTS 2,385,753 9/1945 Young ..... 299/22
2,814,475 11/1957 Jay ..... 299/23
3,439,954 4/1969 Darda ..... 299/22
3,488,093 1/1970 Darda ..... 299/22
3,572,840 3/1971 Fletcher ..... 299/23
3,894,772 7/1975 Darda ..... 299/22
4,026,602 5/1977 Bieri ..... 299/22
4,114,951 9/1978 Langfield et al. ..... 299/22

FOREIGN PATENT DOCUMENTS 580323 11/1977 U.S.S.R. ..... 299/22

*Primary Examiner*—Ernest R. Purser
*Attorney, Agent, or Firm*—Armstrong, Nikaido, Marmelstein & Kubovcik

[57] ABSTRACT

For splitting rock, concrete structures, etc., by being inserted into a drill hole created therein, a rock splitter has a wedge coupled at its thick end to the output shaft of a hydraulic cylinder. Lying on opposite sides of the wedge, a pair of guides are yieldably held against the wedge to allow longitudinal sliding motion thereof. Two pairs of opposed leaf springs connect the wedge guides to the hydraulic cylinder to restrain the guides from longitudinal displacement and to allow same to move away from and toward each other with the longitudinal sliding motion of the wedge. The pair of wedge guides, together with the wedge therebetween, generally taper as they extend away from the hydraulic cylinder for the ease of insertion into the drill hole. Several splitting operations, each with a thrust of the wedge, are to be performed in succession, by inserting the splitter progressively deeper into the drill hole, for fracturing thick rock formations or the like.

23 Claims, 15 Drawing Figures

POWER-DRIVEN, WEDGE-OPERATED ROCK SPLITTER

BACKGROUND OF THE INVENTION

Our invention relates to a rock splitter, that is, an apparatus for splitting or fracturing rock, concrete structures, etc., by being inserted into a drill hole created therein. The rock splitter in accordance with our invention is of the type having a wedge driven by a hydraulic cylinder or like actuator.

Several problems have been attendant upon rock splitters of the class under consideration. One is the difficulty of insertion of a rock splitter to a required depth in a drill hole formed in rock to be fractured. The difficulty arises because the drill hole is not exactly cylindrical but usually has bends and irregularities of the wall surface. Consequently, even if smaller in width than the nominal diameter of the drill hole, the wedge assembly of the rock splitter has been easy to jam in the hole before full insertion therein.

A conventional measure to counter this problem has been to make the pair of wedge guides of the wedge assembly, slidably holding the wedge therebetween, considerably thicker at their forward or lower end portions, and to drill holes of correspondingly large diameter in rock to be split. This known solution is subject to the objection that the clearance between the slender portion of the wedge assembly and the wall surface of the drill hole serves no useful purpose in splitting the rock. Also, since the wedge assembly makes direct contact with the rock only at its thick end portion, the reactive forces of the rock concentrate at this portion, giving rise to the possibility of seizure of the wedge between the guides through excessive pressure and friction. Further the slender portion of the wedge assembly has been easy to become distorted by stresses exerted thereon during the thrust of the wedge. Still further the strength of the slender portion of the wedge assembly sets a limit on the force with which the hydraulic cylinderthrusts down the wedge. An additional drawback is that the prior art rock splitter becomes totally unusable in the event of lessening of the drill hole diameter through wear of the drill bit, unless the bit is replaced.

Another problem with the prior art concerns the splitting of large rock or the like. Most rock splitters available today, for use in drill holes ranging from 40 to 60 millimeters in diameter, can create a rupture having a maximum width of 15 to 20 millimeters, with one thrust of the wedge. This is insufficient for thoroughly splitting extremely large rocks or thick rock formations. The usual practice in such cases is to withdraw the rock splitter out of the drill hole after the initial thrust of the wedge and to replace the wedge guides with thicker ones or to insert spacers in the wedge assembly. Then the splitter is reinserted in the drill hole, whose diameter has been increased by the initial thrust of the wedge, to repeat the wedging operation.

This conventional practice is objectionable in view of the time-consuming and troublesome operation of wedge guide replacement or spacer insertion. Moreover, having been broken loose by the initial thrust of the wedge, the wall of the drill hole more or less crumbles during the withdrawal and reinsertion of the rock splitter. The consequent increase in the diameter of the drill hole makes the subsequent wedging operation materially less effective in spite of the use of thicker wedge guides or of spacers.

As an alternative to the above conventional practice it may be contemplated to increase the stroke of the wedge. This solution is impractical, or at least highly uneconomical, because of the need for the use of a hydraulic cylinder of correspondingly long piston stroke and for the drilling of correspondingly deep holes.

A further problem with the conventional rock splitters pertains to the diameter of drill holes to be formed in rock for receiving them. If the wedging force of the prior art devices is to be increased for more efficient splitting operation, their wedge assemblies must be made larger in cross sectional size to gain strength for withstanding the increased force. The larger wedge assemblies require, of course, correspondingly large drill holes. However, the greater the diameter of drill holes, the longer time and the more expensive equipment are needed to create them.

SUMMARY OF THE INVENTION

Our invention remedies all the listed problems of the prior art and provides an improved power-driven, wedge-operated rock splitter of simplified, inexpensive construction capable of efficiently splitting rock, concrete structures, etc., by being inserted into drill holes of smaller diameter than heretofore formed therein. The improved rock splitter is also notable for the mechanical strength with which it withstands stresses exerted thereon during wedging operation.

Summarized briefly, the rock splitter of our invention includes a wedge coupled at its thick end to a linearly reciprocating output member of an actuator such as a hydraulic cylinder. Extending along the opposite tapering sides of the wedge are a pair of guides which are yieldably held against the wedge to allow longitudinal sliding motion thereof. The pair of guides, together with the wedge therebetween, generally taper as they extend away from the cylinder. Also included are means for connecting the pair of guides to the cylinder body so as to restrain the guides from longitudinal displacement but to allow the guides to move away from and toward each other with the longitudinal sliding motion of the wedge with the cylinder output shaft.

In the use of the above outlined rock splitter for splitting a thick rock formation, for example, the tapering wedge assembly (comprising the wedge and the pair of guides on its opposite sides) is to be inserted as far as possible into a drill hole created therein, the drill hole having a diameter only slightly more than the minimum width of the wedge assembly. Then the wedge is forced down to create a rupture in the rock formation and hence to enlarge the drill hole. Then the wedge assembly is inserted deeper, again as far as possible, into the enlarged drill hole, and again the wedge is thrusted down to widen the rupture. The same procedure is repeated until finally the rock formation is torn apart.

Thus, at the time of each thrust of the wedge, the wedge assembly makes close contact with the wall of the drill hole by virtue of its tapering shape, so that the spreading of the guides with the thrust of the wedge can be substantially wholly translated into the width of the rupture in the rock formation. For this reason the angle of the wedge can be reduced, and no excessive cylinder force is required for driving the wedge. Further the relatively sliding surfaces of the wedge assembly receive no localized pressures, with the consequent avoidance of seizure or uneven wear. The tapering configuration of the wedge assembly is also advantageous because of its improved strength against tensile and bending stresses, making it possible to increase the wedge-driving force of the cylinder as required.

It will further be appreciated that the rock splitter of our invention does not require the replacement of the guides with thicker ones or the insertion of spacers as it is inserted deeper and deeper into the drill hole for repeated wedging. A still further advantage of our invention manifests itself when the drill hole is not exactly cylindrical. Although the prior art devices have been difficult of insertion into such holes, the tapering wedge assembly of the improved rock splitter can be readily inserted therein to a required degree. Furthermore, since the wedge assembly is inserted to successively greater depths by enlarging the drill hole at each depth, no difficulty is to be encountered even if the hole, as initially drilled, is distorted considerably.

Additional features of our invention reside in the means for connecting the pair of wedge guides to the cylinder body in the above described manner. In preferred embodiments of our invention disclosed herein the connecting means comprise two pairs of opposed leaf springs extending between retainer means on the cylinder body and on the wedge guides. In one embodiment the two leaf spring pairs extend in coplanar relationship to the pair of wedge guides. In another embodiment the two spring pairs are each parallel to each other, but with a spacing therebetween less than the distance between the upper ends of the wedge guides when the wedge is in a most retracted position. Both of these arrangements serve to reduce bending stresses exerted on the junctions between the wedge guides and the retainer means thereon during the thrust of the wedge.

The above and other features and advantages of our invention and the manner of attaining them will become more apparent, and the invention itself will best be understood, from a study of the following description of the preferred embodiments taken together with the attached drawings.

DESCRIPTION OF THE PREFERRED EMBODIMENTS

Figure 1:
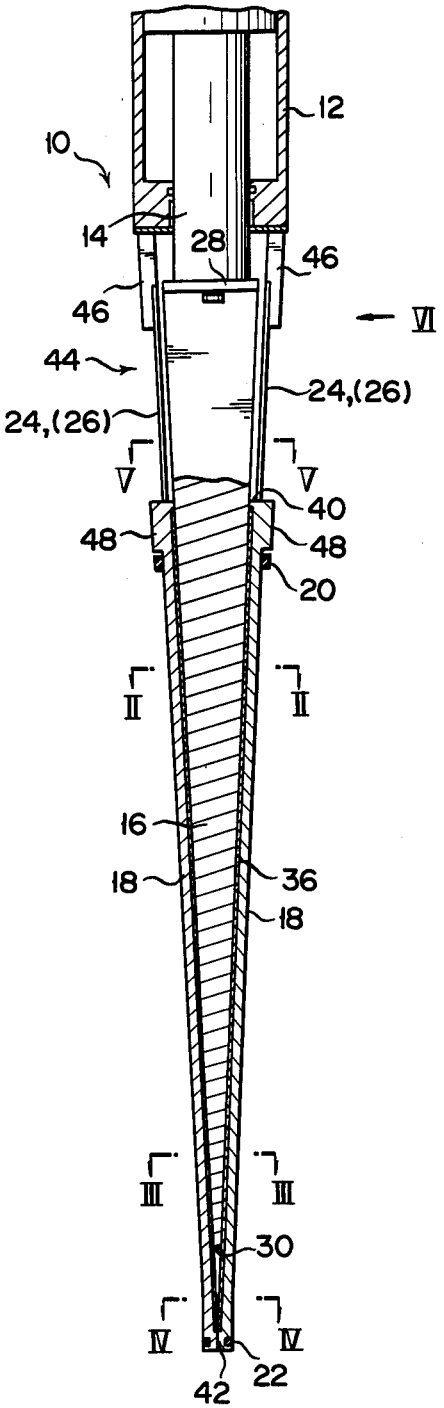
FIG. 1 is a longitudinal or vertical sectional view, with parts shown in elevation for illustrative convenience, of the rock splitter constructed in accordance with our invention.
Figure 2:
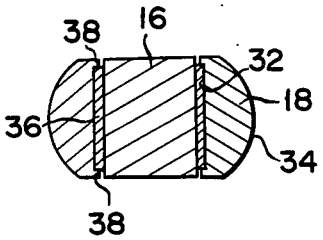
FIG. 2 is a section through the rock splitter taken along the line II—II of FIG. 1 and showing the wedge and guide means therefor.
Figure 3:
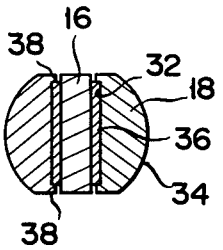
FIG. 3 is a section through the rock splitter taken along the line III—III of FIG. 1 and also showing the wedge and its guide means.
Figure 4:
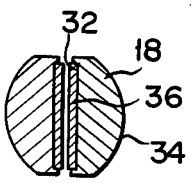
FIG. 4 is a section through the rock splitter taken along the line IV—IV of FIG. 1 and showing the wedge guide means.

We will now describe in detail the power-driven, wedge-operated rock splitter of our invention as represented by two preferable forms illustrated in the accompanying drawings. FIGS. 1 to 6 show the first of the representative forms. Generally identified by the reference numeral 10 in FIG. 1, the first representative rock splitter broadly comprises:

1. A linear actuator 12 having a reciprocating output shaft 14.
2. An elongate wedge 16 rigidly coupled to the output shaft 14 of the actuator 12.
3. A pair of guides 18 disposed on opposite tapering sides of the wedge 16 and yieldably held against same by two rings 20 and 22 of elastic material, allowing the wedge to slide longitudinally relative to the guides.
4. Two pairs of opposed leaf or flat springs 24 and 26 connecting the pair of guides 18 to the linear actuator 12 in a manner restraining the guides from longitudinal displacement but allowing the guides to move away from and toward each other with the longitudinal sliding motion of the wedge 16.

A preferred form of the linear actuator 12 is a hydraulic cylinder, as drawn, so that we will hereinafter refer to the actuator as the cylinder. The wedge 16 has a thick edge 28 and a thin edge 30 at its opposite ends. Having its thick edge 28 rigidly fastened to the output shaft 14 of the cylinder 12, the wedge 16 is to be thrusted forwardly or downwardly and to be retracted back to the illustrated position. The wedge is of bilateral symmetry when viewed as in FIG. 1, tapering as it extends away from the cylinder output shaft 14 and, when in the retracted position, terminating short of the distal ends of the wedge guides 18, as will be seen also from FIGS. 2, 3 and 4.

The pair of wedge guides 18 extend along the opposite working sides of the wedge 16. The top ends of these wedge guides, as viewed in FIG. 1, lie some distance below the thick top end of the wedge in its retracted position. In the illustrated embodiment each wedge guide 18 is of constant cross sectional shape and size throughout its length, having, as identified in FIGS. 2 to 4, a flat inner surface 32 and an outer surface 34 which is convexed as viewed cross sectionally as in these figures. Thus, in accordance with a feature of our invention, the pair of wedge guides 18 together with the wedge 16 therebetween generally taper as they extend away from the cylinder 12.

Although the flat inner surfaces 32 of the wedge guides 18 may make direct sliding contact with the wedge 16, provided that they offer sufficiently low friction, we prefer the use of separate antifriction linings. The antifriction linings in this particular embodiment take the form of flat strips of antifriction material, indicated at 36 in FIGS. 1 to 4, held against the flat inner surfaces 32 of the wedge guides 18. Each wedge guide has a pair of parallel rims 38 projecting inwardly from the opposite sides of its inner surface for holding one strip 36 of antifriction material against sidewise displacement. Each wedge guide has also rims 40 and 42, FIG. 1, projecting inwardly from its opposite ends to restrain the antifriction strip from endwise displacement.

The rings 20 and 22 of rubber or like elastic material encircle the pair of wedge guides 18 at their top and bottom ends. These elastic rings function to hold the wedge guides against the wedge 16 and to allow the guides to move away from and toward each other with the longitudinal sliding motion of the wedge away from and toward the cylinder 12.

Figure 6:
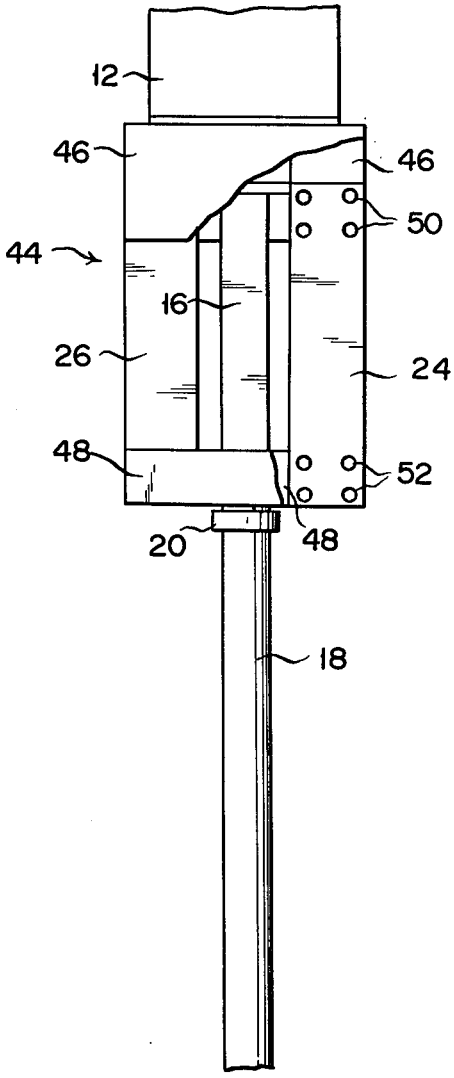
FIG. 6 is a fragmentary elevational view of the rock splitter as seen in the direction of the arrow VI in FIG. 1, the view also showing in particular the means for connecting the pair of wedge guides to the cylinder.
Figure 5:
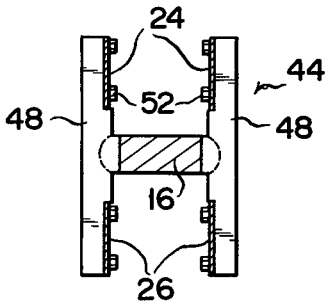
FIG. 5 is a section through the rock splitter taken along the line V—V of FIG. 1 and showing the means for connecting the pair of wedge guides to the wedge-driving cylinder.

Generally labeled 44 in FIGS. 1, 5 and 6 are means, including the two pairs of opposed leaf springs 24 and 26, for connecting the pair of wedge guides 18 to the cylinder 12 in the manner set forth previously. Constituting another important feature of our invention, the connecting means 44 further include a first pair of retainers 46 depending from the cylinder 12 in parallel spaced relationship to each other. The retainers 46 lie on opposite sides of the cylinder output shaft 14, or of the wedge 16, and each extends at right angles with the wedge. A second pair of retainers 48 are formed on the top ends of the wedge guides 18 in parallel spaced relationship to each other and to the first pair of retainers 46. The two pairs of opposed leaf springs 24 and 26 extend between, and are screwed or otherwise fastened as at 50 and 52 to, the first 46 and second 48 pairs of retainers. Thus are the two pairs of leaf springs disposed on opposite sides of the wedge 16 and in parallel spaced relationship to each other.

What is more important, as will be best understood from FIG. 1, each pair of opposed leaf springs 24 or 26 extend in coplanar relationship to the pair of wedge guides 18, diverging as the leaf springs extend upwardly from the wedge guides toward the cylinder 12. This arrangement of the leaf springs serves to eliminate any undue bending stresses that would be exerted on the junctions between the wedge guides 18 and the retainers 48 during the downward thrust of the wedge 16 if each pair of leaf springs were parallel to each other with a spacing therebetween greater than the width of the wedge portion therebetween. The above leaf spring arrangement also makes it possible to make the stroke of the wedge sufficiently long. Although we have used two pairs of opposed leaf springs in the illustrated embodiment, it will be seen that the same purpose could be attained with the use of a single pair of leaf springs if each spring had a width approximately equal to the length of the retainers 46 and 48.

Alternative Form

FIGS. 7 to 12 illustrate another preferable form of the rock splitter in accordance with our invention. We will identify the various parts of this alternative rock splitter by the same reference numerals as used to denote the corresponding parts, if any, of the rock splitter 10 of FIGS. 1 to 6, only with the digit "1" prefixed to such numerals. To the other, newly appearing parts of the alternative rock splitter we will refer with use of numerals 160 and upward.

Figure 7:
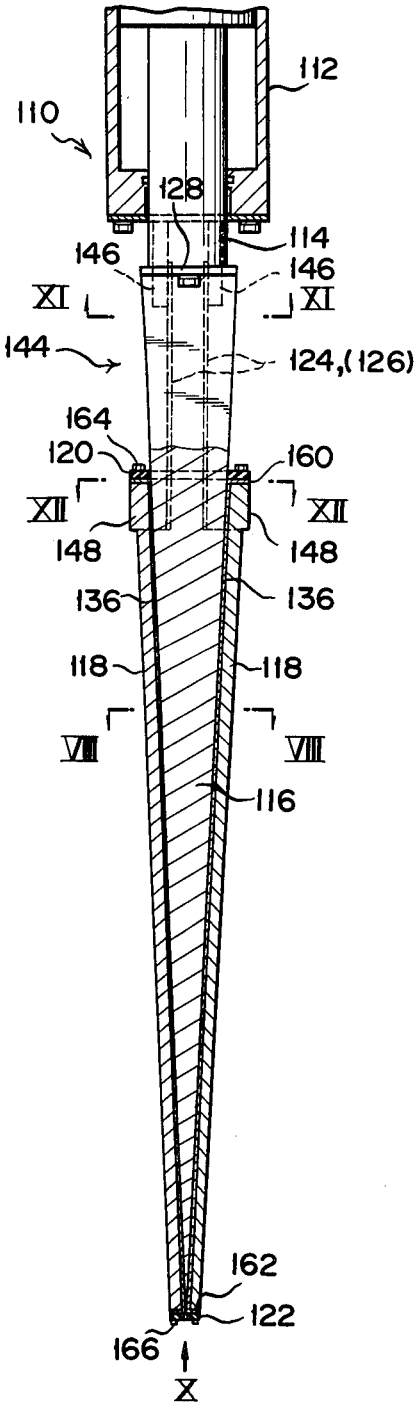
FIG. 7 is a view corresponding to FIG. 1 and showing an alternative form of the rock splitter constructed in accordance with our invention.
Figure 8:
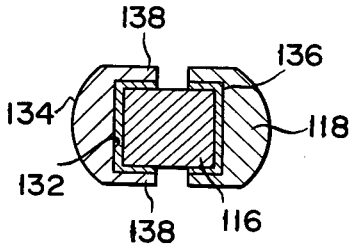
FIG. 8 is a section through the alternative rock splitter taken along the line VIII—VIII of FIG. 7 and showing the wedge and modified guide means therefor.

Generally referenced 110 in FIG. 7, the alternative rock splitter broadly comprises:

1. A hydraulic cylinder 112 having an output shaft 114.
2. An elongate wedge 116 rigidly fastened at its thick edge 128 to the output shaft 114 of the cylinder 112.
3. A pair of guides 118, complete with antifriction linings 136, extending along the opposite sides of the wedge 116 and yieldably held against same by two connectors 120 and 122 of elastic material at their opposite ends, allowing the wedge to slide up and down relative to the guides.
4. Two pairs of opposed leaf springs 124 and 126 connecting the pair of wedge guides 118 to the cylinder 112 to permit the guides to move only away from and toward each other with the longitudinal sliding motion of the wedge 116.

The cylinder 112 and the wedge 116 are exactly identical with the cylinder 12 and the wedge 16 of the rock splitter 10. The manner of their connection is also as set forth above in connection with the preceding embodiment. However, as will be noted from FIG. 8 in particular, the pair of wedge guides 118 and their antifriction linings 136 slightly differ in cross sectional shape from the wedge guides 18 and their antifriction linings 36. Each wedge guide 118 has a flat inner surface 132 and a convex outer surface 134, as does each wedge guide 18, but a pair of parallel rims 138 project inwardly from the opposite sides of the flat inner surface 132 to a greater extent than the rims 38 of the wedge guide 18. Extending throughout the length of the wedge guides 118, the pairs of rims 138 externally engage the wedge 116 to restrain same from sidewise displacement.

Figure 9:
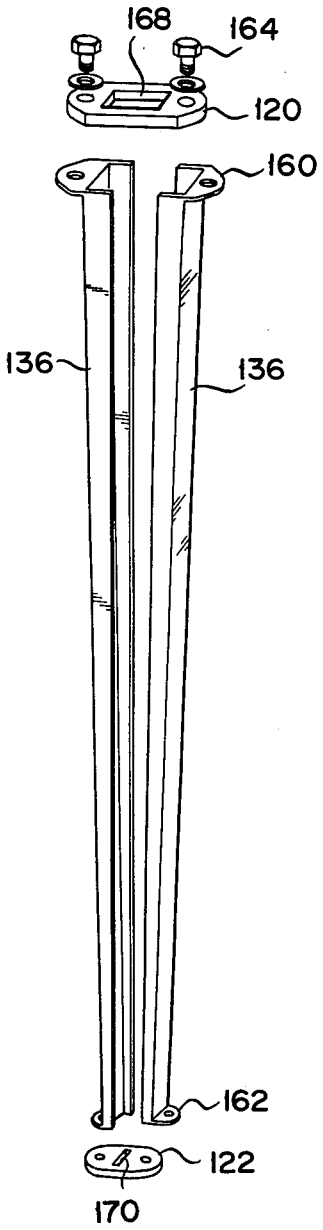
FIG. 9 is an exploded perspective view of a pair of strips of antifriction material lining the wedge guides, two connectors of elastic material, and associated fastening means used in the alternative rock splitter.
Figure 10:
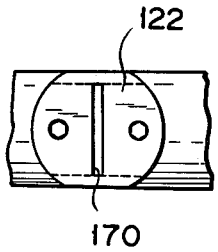
FIG. 10 is an enlarged end view of the alternative rock splitter as seen in the direction of the arrow X in FIG. 7, the view showing in particular one of the elastic connectors shown also in FIG. 9.

For use with the modified pair of wedge guides 118 each antifriction lining 136 takes the form of a channel-shaped strip, as better pictured in FIG. 9. The channel-shaped antifriction strip covers the inner surface 132 of each wedge guide 118 as well as the inner surfaces of its side rims 138 for direct sliding engagement with the wedge 116.

FIG. 9, as well as FIG. 1, also reveals lugs 160 and 162 bent outwardly from the opposite ends of each channel-shaped antifriction strip 136 into overlying, and underlying, relation with the opposite ends of one wedge guide 118. The noted connectors 120 and 122 of rubber or like elastic material are screwed at 164 and 166 to the opposite ends of the pair of wedge guides 118 via the lugs 160 and 162 of the antifriction strips 136, so that the screws 164 and 166 serve to fasten both the antifriction strips and the elastic connectors to the wedge guides.

As best seen in FIG. 9, the upper elastic connector 120 has formed therein a rectangular opening 168 to allow the wedge 116 to pass closely and slidably therethrough. The lower elastic connector 122 also has formed therein a rectangular opening or slot 170, as shown also in FIG. 9 and on an enlarged scale in FIG. 10, to closely and slidably receive the thin edge portion of the wedge 116 as the latter is thrusted down beyond the lower extremities of the wedge guides 118. Thus, unlike the elastic rings 20 and 22 of the FIGS. 1 to 6 embodiment, the elastic connectors 120 and 122 function to prevent the intrusion of foreign matter such as broken rock fragments or particles between the relatively sliding surfaces of the wedge 116 and the antifriction linings 136 of the wedge guides 118, besides serving to yieldably hold the guides against the wedge.

Figure 11:
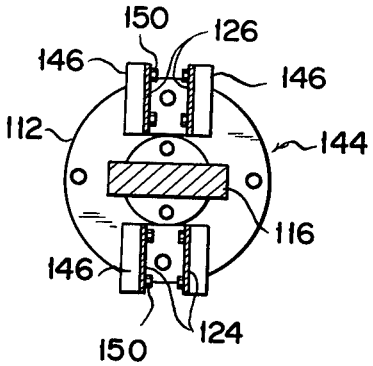
FIG. 11 is a section through the alternative rock splitter taken along the line XI—XI of FIG. 7 and showing in particular modified means for connecting the pair of wedge guides to the wedge-driving cylinder.
Figure 12:
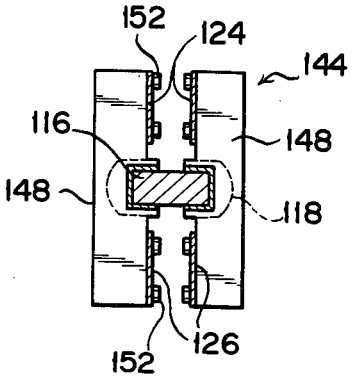
FIG. 12 is a section through the alternative rock splitter taken along the line XII—XII of FIG. 7 and also showing the modified means for connecting the pair of wedge guides to the cylinder.

A consideration of FIGS. 7, 11 and 12 will clarify the configuration of means 144, including the two pairs of opposed leaf springs 124 and 126, for connecting the pair of wedge guides 118 to the cylinder 112 in the above described manner. The connecting means 144 further include two pairs of opposed retainers 146 depending from the cylinder 112 and disposed on opposite sides of the cylinder output shaft 114 and of the wedge 116. Another pair of opposed retainers 148 are formed on the top ends of the wedge guides 118 so as to extend across the wedge 116. The two pairs of leaf springs 124 and 126 extend between, and have their ends screwed or otherwise fastened as at 150 and 152 to, the two pairs of retainers 146 on the cylinder 112 and the pair of retainers 148 on the wedge guides 118. Thus are the two pairs of leaf springs disposed on opposite sides of the wedge 116, with each pair oriented parallel to each other and with a spacing therebetween less than the distance between the top ends of the wedge guides 118 when the wedge is in a most retracted position as in FIG. 7.

The reduced spacing between each pair of leaf springs 124 or 126 constitutes an important feature of the modified connecting means 144. Since the leaf springs are not too far away from the axis of the wedge 116, no excessive bending stresses are to be exerted on the junctions between the wedge guides 118 and the retainers 148 during the downward thrust of the wedge.

Operation

Figure 13:
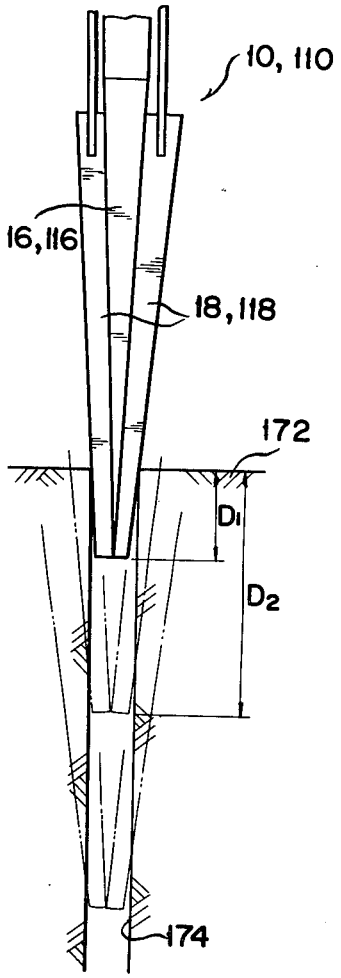
FIG. 13 is a fragmentary, diagrammatic representation of the rock splitter in accordance with the invention in the act of splitting a rock formation by being inserted in a drill hole formed therein.

The two representative forms 10 and 110 of the rock splitter in accordance with our invention operate, or are to be used, in the same way, so that we will discuss their operations together in connection with FIG. 13. Depicted in this figure is the rock splitter 10 or 110 in the act of splitting a rock formation 172. The rock splitting operation starts with the drilling of one or more holes 174 to a required depth in the rock formation 172. The diameter of the drill hole 174 needs to be only slightly more than the minimum combined width of the tapering pair of wedge guides 18 or 118, with the wedge 16 or 116 held in the most retracted position therebetween.

Then the rock splitter 10 or 110 is inserted into the drill hole 174 as deeply as possible. The drill hole has such a smaller diameter that the rock splitter will enter the hole to a fraction $D_1$ of its total depth, with only a lower end portion of its guide pair 18 or 118 received and caught in the hole. Then the cylinder 12 or 112 of the rock splitter is extended, causing downward thrust of the wedge 16 or 116 and thereby spreading the pair of wedge guides 18 or 118 apart to produce a rupture in the rock formation 172. Since the rock splitter is inserted a small distance in the drill hole, no great hydraulic energy will be required to cause the downward thrust of the wedge, and no excessive pressure will develop between the sliding surfaces of the wedge and its lined guides.

The single thrust of the wedge will suffice to fracture smaller rocks or concrete structures. However, the rock formation 172 under consideration is assumed to be of considerable thickness, demanding several such thrusts to be completely torn apart. Thus the wedge is temporarily withdrawn, with the consequent contraction of the guides. Although the rupture created in the rock formation by the initial thrust of the wedge will diminish in width upon withdrawal of the wedge, nevertheless the diameter of the drill hole 174 therein will have become greater. The rock splitter can now be inserted in the drill hole to a correspondingly greater depth $D_2$. Then the wedge is again thrusted down, thus widening the rupture in the rock formation to the same extent as the wedge guides are spread apart. Such cycles of operation are to be repeated as quired until the complete splitting of the rock formation.

Modifications

Figure 14:
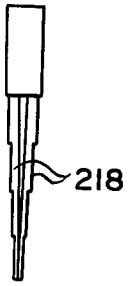
FIG. 14 is a diagrammatic representation of further modified wedge guide means.
Figure 15:
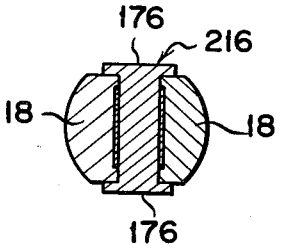
FIG. 15 is a view corresponding to FIG. 3 and showing a modified wedge and guide means therefor.

Although we have shown and described the rock splitter of our invention in what we have conceived to be the most practical and preferred forms thereof, we understand that these are by way of example only and not to impose limitations upon the invention. For a variety of modifications or changes will readily occur to the specialists on the basis of this disclosure. For example, the pair of wedge guides 18 or 118 need not be each of constant cross sectional shape and size throughout their length, all that is required being that they, together with the wedge therebetween, generally taper as they extend away from the hydraulic cylinder or like actuator. As an alternative, therefore, there may be employed a pair of wedge guides 218 schematically illustrated in FIG. 14, each decreasing stepwise in cross sectional size as it extends away from the actuator. Also the wedge 16 or 116 need not be of rectangular cross sectional shape. FIG. 15 shows a modified wedge 216 of I-shaped cross section, including a pair of flanges 176 for externally engaging the pair of wedge guides 18 therebetween, in order to be thereby constrained to longitudinal motion only.

All these and other modifications or changes within the usual knowledge of the specialists are intended in the foregoing disclosure. Consequently our invention is to be accorded the full scope of the appended claims so as to embrace any and all equivalent devices.

What we claim is:

1. An apparatus for splitting rock, concrete structures, etc., by being inserted into a drill hole created therein, comprising:

(a) an actuator having a linearly reciprocating output member;

(b) a wedge having a thick edge and a thin edge at opposite ends thereof and having the thick edge coupled to the output member of the actuator for longitudinal motion therewith;

(c) a pair of guides extending along and disposed on opposite sides of the wedge to allow longitudinal sliding motion thereof, the pair of guides, together with the wedge slidably engaged therebetween, generally tapering as they extend away from the actuator, the pair of guides having antifriction linings for direct relative sliding contact with the wedge, each antifriction lining being in the form of a flat strip of antifriction material held against a flat inner surface of one guide, each guide having a pair of parallel rims projecting inwardly from opposite sides of its inner surface for holding one strip of antifriction material against lateral displacement;

(d) means for yieldably holding the pair of guides against the wedge; and (e) means for connecting the pair of guides to the actuator so as to restrain the guides from longitudinal displacement and to allow the guides to move away from and toward each other with the longitudinal sliding motion of the wedge with the output member of the actuator.

2. The apparatus of claim 1, wherein each guide is of constant cross sectional shape and size throughout the length thereof.

3. The apparatus of claim 2, wherein each guide has a flat inner surface and an outer surface which is convexed when the guide is viewed cross sectionally.

4. The apparatus of claim 1, wherein the yieldably holding means comprises two rings of elastic material encircling the pair of guides at opposite ends thereof.

5. The apparatus of claim 1, wherein the connecting means comprises:

(a) first retainer means on the actuator;

(b) second retainer means on the pair of guides; and (c) leaf spring means secured to and extending between the first and the second retainer means.

6. The apparatus of claim 5, wherein the leaf spring means comprises a pair of opposed leaf springs oriented in coplanar relationship to the pair of guides.

7. The apparatus of claim 5, wherein the leaf spring means comprises two pairs of opposed leaf springs lying on opposite sides of the wedge, the two pairs of opposed leaf springs being disposed in parallel spaced relationship to each other and in coplanar relationship to the pair of guides.

8. The apparatus of claim 5, wherein the leaf spring means comprises two pairs of leaf springs lying on opposite sides of the wedge, each pair of leaf springs being oriented parallel to each other, with a spacing therebetween less than the distance between those ends of the pair of guides which are directed toward the actuator, when the wedge is in a most retracted position.

9. The apparatus of claim 1, wherein the cross sectional size of each guide decreases stepwise as same extends away from the actuator.

10. The apparatus of claim 1, wherein the wedge is of I-shaped cross section, including a pair of flanges externally engaging the pair of guides therebetween.

11. An apparatus for splitting rock, concrete structures, etc., by being inserted into a drill hole created therein, comprising:

(a) an actuator having a linearly reciprocating output member;

(b) a wedge having a thick edge and a thin edge at opposite ends thereof and having the thick edge coupled to the output member of the actuator for longitudinal motion therewith;

(c) a pair of guides extending along and disposed on opposite sides of the wedge to allow longitudinal sliding motion thereof, the pair of guides, together with the wedge slidably engaged therebetween, generally tapering as they extend away from the actuator, each guide having a pair of rims projecting inwardly from opposite sides of its inner surface for externally engaging the wedge therebetween and restraining same from lateral displacement;

(d) means for yieldably holding the pair of guides against the wedge; and (e) means for connecting the pair of guides to the actuator so as to restrain the guides from longitudinal displacement and to allow the guides to move away from and toward each other with the longitudinal sliding motion of the wedge with the output member of the actuator.

12. The apparatus of claim 11, wherein the pair of guides have antifriction linings for direct relative sliding contact with the wedge.

13. The apparatus of claim 12, wherein each antifriction lining is in the form of a flat strip of antifriction material held against a flat inner surface of one guide, and wherein each guide has a pair of parallel rims projecting inwardly from opposite sides of its inner surface for holding one strip of antifriction material against lateral displacement.

14. The apparatus of claim 11, further comprising a channel-shaped strip of antifriction material lining each rimmed guide for direct relative sliding contact with the wedge.

15. The apparatus of claim 11, wherein the yieldably holding means comprises two connectors of elastic material secured to the opposite ends of the pair of guides, the connectors being shaped and sized to closely and yieldably fit over the wedge to serve also to prevent the intrusion of foreign matter between the relatively sliding surfaces of the wedge and the guides.

16. The apparatus of claim 15, further comprising strips of antifriction material lining the pair of guides for direct relative sliding contact with the wedge, each antifriction strip having lugs bent outwardly from its opposite ends, and wherein the connectors are fastened to the opposite ends of the pair of guides via the lugs of the antifriction strips.

17. The apparatus of claim 11, wherein each guide is of constant cross sectional shape and size throughout the length thereof.

18. The apparatus of claim 17, wherein each guide has a flat inner surface and an outer surface which is convexed when the guide is viewed cross sectionally.

19. The apparatus of claim 11, wherein the connecting means comprises:

(a) first retainer means on the actuator;

(b) second retainer means on the pair of guides; and (c) leaf spring means secured to and extending between the first and the second retainer means.

20. The apparatus of claim 19, wherein the leaf spring means comprises a pair of opposed leaf springs oriented in coplanar relationship to the pair of guides.

21. The apparatus of claim 19, wherein the leaf spring means comprises two pairs of opposed leaf springs lying on opposite sides of the wedge, the two pairs of opposed leaf springs being disposed in parallel spaced relationship to each other and in coplanar relationship to the pair of guides.

22. The apparatus of claim 19, wherein the leaf spring means comprises two pairs of leaf springs lying on opposite sides of the wedge, each pair of leaf springs being oriented parallel to each other, with a spacing therebetween less than the distance between those ends of the pair of guides which are directed toward the actuator, when the wedge is in a most retracted position.

23. The apparatus of claim 11, wherein the cross sectional size of each guide decreases stepwise as same extends away from the actuator.

* * * * *